US006522112B1

(12) United States Patent
Schmoock et al.

(10) Patent No.: US 6,522,112 B1
(45) Date of Patent: Feb. 18, 2003

(54) LINEAR REGULATOR COMPENSATION INVERSION

(75) Inventors: James Charles Schmoock, Granite Bay, CA (US); Jeffrey P. Kotowski, Nevada City, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/011,238

(22) Filed: Nov. 8, 2001

(51) Int. Cl.[7] ..... G05F 1/40
(52) U.S. Cl. ..... 323/280
(58) Field of Search ..... 323/273, 280, 323/281, 349

(56) References Cited

U.S. PATENT DOCUMENTS 4,908,566 A * 3/1990 Tesch ..... 323/200
5,850,139 A * 12/1998 Edwards ..... 323/280
5,889,393 A * 3/1999 Wrathall ..... 323/280
5,945,818 A * 8/1999 Edwards ..... 323/273
5,982,226 A * 11/1999 Rincon-Mora ..... 323/273
6,130,527 A * 10/2000 Bontempo et al. ..... 323/280
6,259,238 B1 * 7/2001 Hasting ..... 323/273

* cited by examiner

*Primary Examiner*—Jeffrey Sterrett
(74) *Attorney, Agent, or Firm*—Brett A. Hertzberg; Merchant & Gould

(57) ABSTRACT

A linear regulator includes an amplifier that provides a control signal in response to a comparison between a feedback signal and an output signal. A pass element in the regulator selectively couples power from an unregulated power signal to an output node in response to the control signal. A compensation circuit that includes negative gain is arranged to provide the feedback signal in response to an output signal at the output node. In one example, the compensation circuit includes an inverting amplifier that provides an intermediary signal in response to the output signal, and the intermediary signal is coupled to a feedback network that provides the feedback signal. In another example, the compensation circuit includes an inverting amplifier that cooperates with a feedback network to provide the feedback signal. The closed-loop transfer functions of the compensation circuits provide a feed-forward zero that enables stable operation of the LDO regulator.

19 Claims, 7 Drawing Sheets

LINEAR REGULATOR COMPENSATION INVERSION

FIELD OF THE INVENTION

The present invention relates to low-dropout regulators. In particular, the present invention relates to a method and apparatus that provides for compensation in a low-dropout regulator.

BACKGROUND OF THE INVENTION

Voltage regulators provide a relatively constant voltage source to other electronic circuits. Some regulators are limited in their effectiveness in a particular application. For example, some regulators have a high "drop-out" voltage. A "drop-out" voltage is the minimum voltage difference between the input voltage and the output voltage that is necessary to maintain proper regulation. Large drop-out voltages result in wasted power, and raise the minimum power supply requirements for maintaining regulation.

A low-dropout regulator (hereinafter an "LDO regulator") is useful in applications where it is desired to maintain a regulated voltage that is sufficiently close to the input voltage. For example, LDO regulators are useful in battery-powered applications where the power supply operates at a low voltage. Frequently, an LDO implementation will employ a compensation network on the output stage to improve stability over the operating margins.

Compensation schemes available to a designer include the addition of a so-called "feed-forward" zero within a feed back loop. FIG. 1 illustrates an LDO regulator (100) that includes compensation using a feed-forward zero. The LDO regulator includes an operational amplifier (op-amp, 101), a PNP transistor (104), a first resistor (103*a*), a second resistor (103*b*), and a capacitor (102). A reference, or band-gap, voltage ($V_{bg}$) is provided to the inverting input of the op-amp (101). An output of the op-amp (101) is connected to the base of the PNP transistor (104). A supply voltage ($V_{in}$) is provided to the emitter of the PNP transistor (104). The collector of the PNP transistor (104) is connected to an output node. The capacitor (102) is series connected from the output node to the non-inverting input of the op-amp (101). The first resistor (103*a*) is series connected from the output node to the non-inverting input of the op-amp (101). The second resistor (103*b*) is connected from the non-inverting input of the amplifier to ground.

The first and second resistors form a voltage divider that provides a negative feedback signal ($F_b$) to the non-inverting input of the op-amp (101). The band-gap voltage ($V_{bg}$) is typically an internally generated regulated voltage around 1.25 volts, and provided from a high-impedance, low-power voltage source. The supply voltage ($V_{in}$) is generally an unregulated raw supply voltage. The amplifier compares the feedback signal ($F_b$) to the band-gap voltage ($V_{bg}$) such that an output voltage ($V_{out}$) is provided at the output node.

The stability of the LDO regulator (100) is analyzed for stability by computing a transfer function. The transfer function for LDO regulator (100) is:

$$\frac{F_b(s)}{V_{out}(s)} = \frac{R_2}{R_2 + R_1} \cdot \frac{R_1 Cs + 1}{(R_1 \| R_2)Cs + 1}.$$

The above transfer function includes a zero ($R_1$Cs+1) and a pole (($R_1 \| R_2$)Cs+1). When the zero and the pole are not significantly separated the additional phase margin afforded by the zero is diminished. For example, when $R_1 << R_2$, $(R_1 \| R_2) \cong R_1$, and the pole and zero cancel one another. When the output voltage ($V_{out}$) is designed to be close to the reference voltage ($V_{bg}$), $R_2$ must be much larger than $R_1$, and the parallel combination of $R_1$ and $R_2$ is approximately equal to $R_1$. Therefore the pole is located very close to the zero and the stability margin is not functionally improved. Additionally, most LDO regulator configurations that utilize a feed-forward zero compensation scheme depend upon the ESR of a load capacitor to introduce an additional zero into the feedback loop. Therefore, lower cost capacitors that are low-ESR cannot be used in such designs.

SUMMARY OF THE INVENTION

The present invention is directed to an apparatus and method for an improved LDO regulator. The LDO regulator has improved compensation allowing the regulator to operate with increased stability.

Briefly stated, a method and apparatus is directed to stable compensation of a linear regulator. The linear regulator includes an amplifier that is configured to provide a control signal in response to a comparison between a feedback signal and an output signal. A pass element in the regulator selectively couples power from an unregulated power signal to an output node in response to the control signal. A compensation circuit that includes negative gain is arranged to provide the feedback signal in response to an output signal at the output node. In one example, the compensation circuit includes an inverting amplifier that provides an intermediary signal in response to the output signal, and the intermediary signal is coupled to a feedback network that provides the feedback signal. In another example, the compensation circuit includes an inverting amplifier that cooperates with a feedback network to provide the feedback signal. The closed-loop transfer functions of the compensation circuits provide a feed-forward zero that enables stable operation of the LDO regulator.

A more complete appreciation of the present invention and its improvements can be obtained by reference to the accompanying drawings, which are briefly summarized below, to the following detail description of presently preferred embodiments of the invention, and to the appended claims.

DETAILED DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function. Whenever possible similar elements follow a common numbering convention throughout the figures.

The present invention is directed to compensating linear regulators using an inverting compensation technique. An amplifier is configured to provide a control signal in response to a comparison between a feedback signal and an output signal. A pass element (i.e. PNP transistor) is configured to receive the control signal and an unregulated power signal, and provides an output signal that corresponds to a regulated output voltage. A compensation circuit is arranged to provide the feedback signal in response to the output signal. In a first example, the compensation circuit includes an inverting amplifier that provides an intermediary signal in response to the output signal, and the intermediary signal is coupled to a feedback network and provides the feedback signal in response to the intermediary signal. In a second example, the compensation circuit includes another amplifier that is arranged as an inverting amplifier that cooperates with a feedback network to provide the feedback signal. The closed-loop transfer functions of the compensation circuits provide a feed-forward zero that enables stable operation of the LDO regulator as will be described in further detail below.

First Example Compensation Configuration

Figure 1:
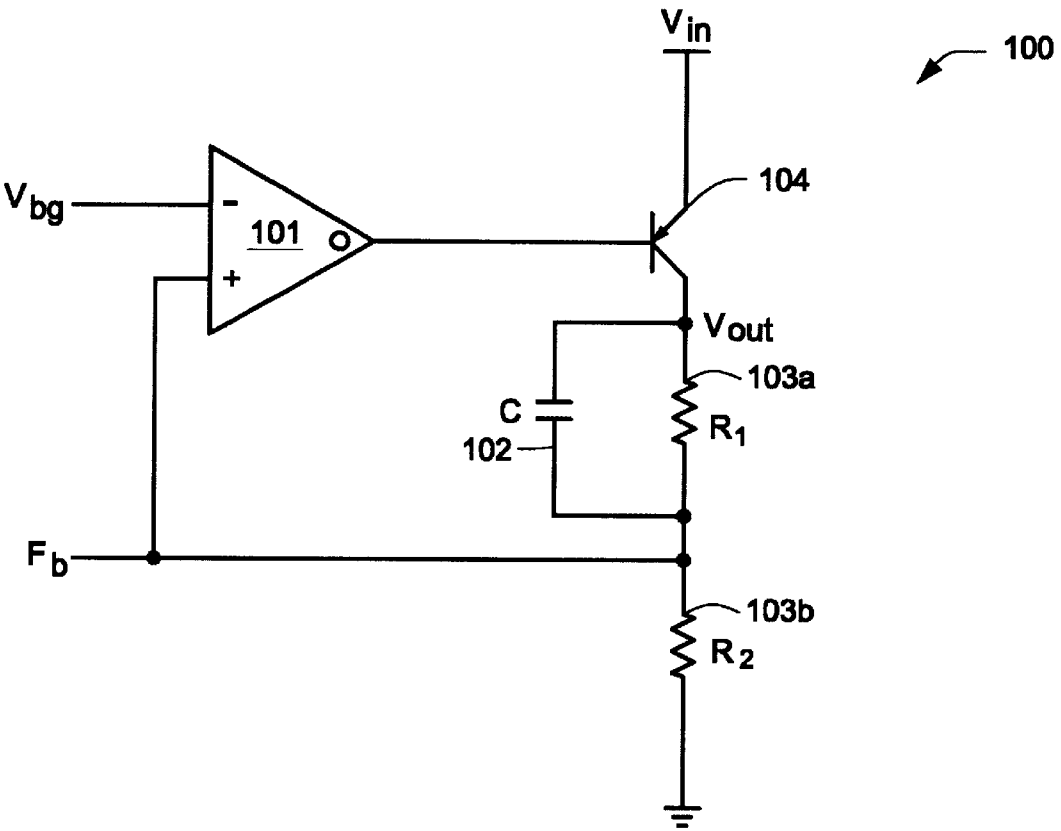
Figure 1 PRIOR ART
FIG. 1 is a schematic diagram of a conventional LDO voltage regulator.
Figure 2:
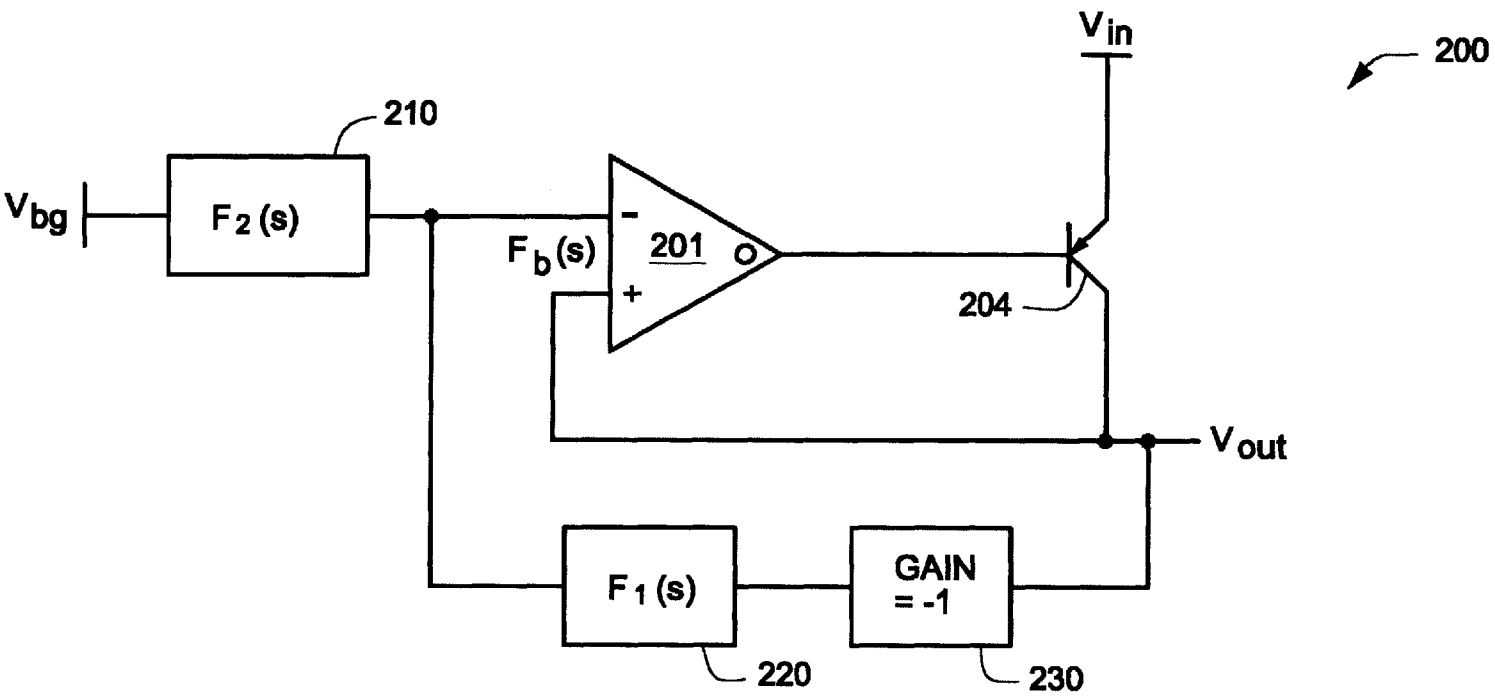
FIG. 2 is a schematic diagram illustrating an LDO voltage regulator compensation configuration.

FIG. 2 is a schematic diagram illustrating an LDO voltage regulator (200) that is compensated for stable operation in accordance with the present invention. The LDO voltage regulator (200) includes an amplifier circuit (201), a pass circuit (204), a first network (220), a second network (210), and a negative gain circuit (230).

The amplifier circuit (201) includes a non-inverting input (+), an inverting input (−), and an output (o). The reference voltage ($V_{bg}$) is coupled to the inverting input (−) of the amplifier circuit (201) through the second network (210). An output node is coupled to the non-inverting input (+) of the amplifier circuit (201) through the negative gain circuit (230) and the first network (220). The pass circuit (204) is coupled between an unregulated supply voltage (Vin) and the output node. The pass circuit also includes a control terminal that is coupled to the output of the amplifier circuit (201).

In operation, an input voltage source (not shown) that has a low source-impedance provides the unregulated supply voltage ($V_{in}$), and a reference circuit (not shown) is arranged to provide the reference voltage ($V_{bg}$). In one example, a band-gap reference circuit is arranged to provide the reference voltage ($V_{bg}$). In the example illustrated in FIG. 2, the reference voltage ($V_{bg}$) is generally of a lower potential than the supply voltage ($V_{in}$). Other voltage reference circuits that provide an appropriate reference voltage may also be employed such as a regulated reference circuit or an unregulated reference circuit.

The output (o) of the amplifier circuit (201) is arranged to provide a control signal to the control input of the pass circuit (204). The pass circuit (204) selectively couples power from the unregulated supply voltage ($V_{in}$) to the output node in response to the control signal such that a regulated output voltage ($V_{out}$) is provided at the output node. The pass circuit (204) illustrated in FIG. 2 is a PNP bipolar-junction transistor that has a base that is configured to receive the control signal, an emitter that is coupled to the unregulated supply voltage ($V_{in}$), and a collector that is coupled to the output node. However, the pass circuit (204) may be any device (or devices) that is suitable to selectively provide power from the supply voltage ($V_{in}$) to the output node when a control signal is applied, such as, but not limited to, a MOSFET, a JFET, GaAs FET, or another controlled circuit.

The negative gain circuit (230) may have any gain with a magnitude that is greater than or equivalent to one. In FIG. 2, the gain of the negative gain circuit (230) has a magnitude of one. The negative gain circuit (230) may be any circuit that is suitable for applying gain to a signal, such as an amplifier, a transistor or a combination of the recited elements, for example. The negative gain circuit (230) is generally powered by the unregulated supply voltage ($V_{in}$) and may contain internal regulation. The application of a negative gain allows negative feedback to occur at the positive feedback node (i.e the inverting input terminal) of the amplifier circuit (201).

A compensation circuit is formed by the combination of the first network (220), the second network (210), and the negative gain circuit (230). The first network (220) and the second network (210) are generally impedance networks comprising passive and/or active devices with specific characteristic impedances. Throughout the specification, the terms "network," "networks," and "network impedance" refer to the same elements and may be used interchangeably. For example, the first network may include a resistor, capacitor, inductor, and any active or passive device or devices in series and/or parallel combination. The first network (220) is represented by the frequency-dependent function, $F_1(s)$. The second network (210) is represented by the frequency-dependent function, $F_2(s)$.

The compensation circuit is arranged to stabilize the AC performance of LDO voltage regulator 200. A feedback signal, represented by $F_b(S)$, appears between the non-inverting input (+) and the inverting input (−) of the amplifier circuit (201). Feedback signal $F_b(s)$ is determined by evaluating the potential difference between the non-inverting (+) and inverting (−) inputs of the amplifier circuit (201). By analyzing the relationship between the feedback signal and the output signal in the AC domain, the stability of voltage regulator is determined. The general form of feedback signal $F_b(s)$ is given by:

$$F_b(s) = V_{out}\left(1 - \frac{-F_2(s)}{F_1(s) + F_2(s)}\right) = V_{out}\left(\frac{F_1(s) + 2F_2(s)}{F_1(s) + 2F_2(s)}\right).$$

The LDO regulator configuration of FIG. 2 allows a very wide range of compensation to be utilized while maintaining excellent phase margin. By properly adjusting the first and second networks (F1(s) and F2(s)), the stability of LDO voltage regulator 200 can be adjusted. The first network (220) and the second network (210) may be complex impedance networks that include passive and/or active devices. For example, the first network (220) may include a resistor, a capacitor, an inductor, and/or any active or passive device in series and/or parallel arrangement. The first network (220) is represented by frequency-dependent function $F_1(s)$. The second network (210) is represented by frequency-dependent function, $F_2(s)$. A specific example for illustration follows in FIG. 3A.

Figure 3A:
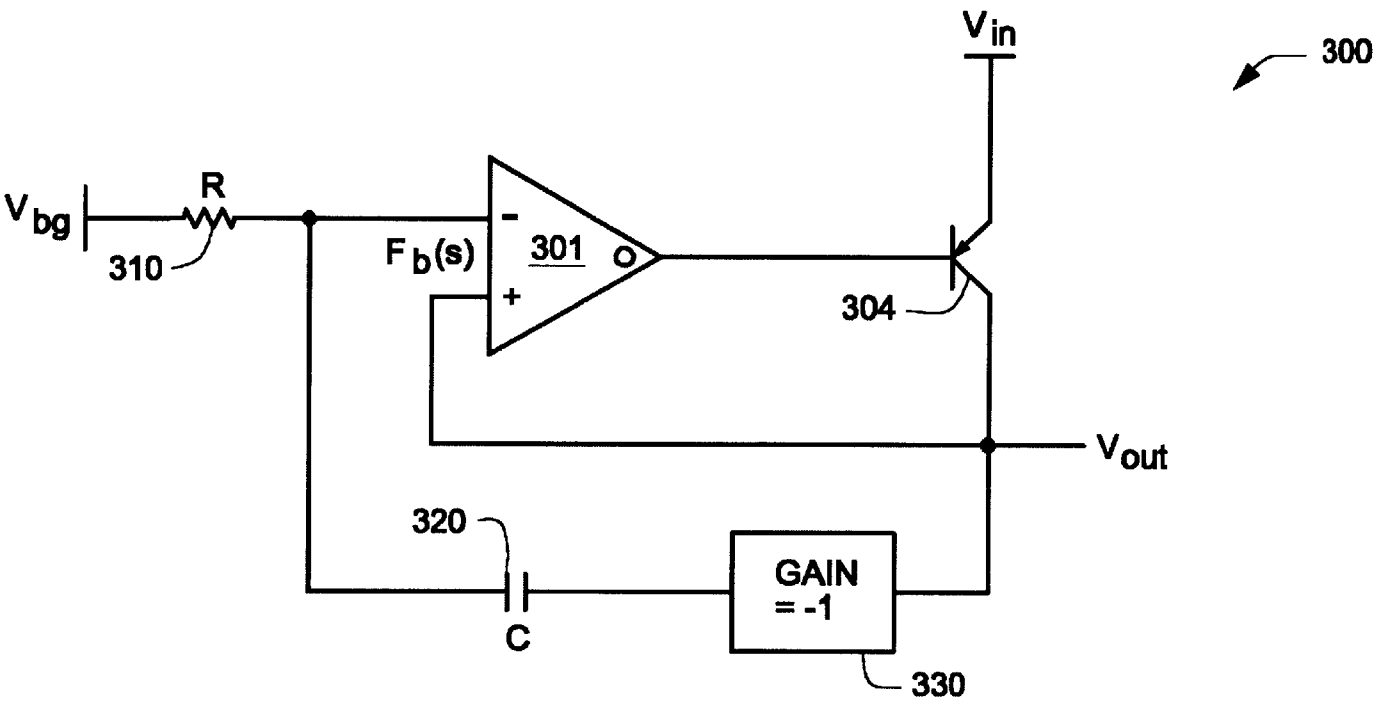
FIG. 3A is a second schematic diagram illustrating an LDO voltage regulator compensation configuration as in FIG. 2.

FIG. 3A is a schematic diagram illustrating an LDO voltage regulator (300) that is compensated for stable operation as in FIG. 2. In FIG. 3A, the LDO voltage regulator (300) includes an amplifier circuit (301), a pass circuit (304), and a negative gain circuit (330). However, in FIG. 3A, the first network (220) of FIG. 2 is replaced with a capacitor (C, 320) and the second network (210) is replaced with a resistor (R, 310).

The amplifier circuit (301) includes a non-inverting input (+), an inverting input (−), and an output (o). The reference voltage ($V_{bg}$) is coupled to the inverting input (−) of the amplifier circuit (301) through the resistor (310). An output node is coupled to the non-inverting input (+) of the amplifier circuit (301) through the negative gain circuit (330) and the capacitor (320). The pass circuit (304) is coupled between an unregulated supply voltage (Vin) and the output node. The pass circuit also includes a control terminal that is coupled to the output of the amplifier circuit (301).

In operation, an input voltage source (not shown) that has a low source-impedance provides the unregulated supply voltage ($V_{in}$), and a reference circuit (not shown) is arranged to provide the reference voltage ($V_{bg}$). In one example, a band-gap reference circuit is arranged to provide the reference voltage ($V_{bg}$). In the example illustrated in FIG. 3A, the reference voltage ($V_{bg}$) is generally of a lower potential than the supply voltage ($V_{in}$). Other voltage reference circuits that provide an appropriate reference voltage may also be employed such as a regulated reference circuit or an unregulated reference circuit.

The output (o) of the amplifier circuit (301) is arranged to provide a control signal to the control input of the pass circuit (304). The pass circuit (304) selectively couples power from the unregulated supply voltage ($V_{in}$) to the output node in response to the control signal such that a regulated output voltage ($V_{out}$) is provided at the output node. The pass circuit (304) illustrated in FIG. 3A is a PNP bipolar-junction transistor that has a base that is configured to receive the control signal, an emitter that is coupled to the unregulated supply voltage (Vin), and a collector that is coupled to the output node. However, the pass circuit (404) may be any device (or devices) that is suitable to selectively provide power from the supply voltage ($V_{in}$) to the output control supply power from the supply voltage ($V_{in}$) when a control signal is applied, such as, but not limited to, a BJT, a MOSFET, a JFET, GaAs FET, a vacuum tube or another controlled circuit.

The negative gain circuit (330) may have any gain with a magnitude that is greater than or equivalent to one. In FIG. 3A, the gain of the negative gain circuit (330) has a magnitude of one. The negative gain circuit (330) may be any circuit that is suitable for applying gain to a signal, such as an amplifier, a transistor or a combination of the recited elements, for example. The application of a negative gain allows negative feedback to occur at the positive feedback node (i.e., the inverting input terminal) of the amplifier circuit (301).

The compensation circuit is arranged to stabilize the AC performance of LDO voltage regulator 300. A feedback signal, represented by $F_b(s)$, appears between the non-inverting input (+) and the inverting input (−) of the amplifier circuit (301). Feedback signal $F_b(S)$ is determined by evaluating the potential difference between the non-inverting (+) and inverting (−) inputs of the amplifier circuit (301). By analyzing the relationship between the feedback signal and the output signal in the AC domain, the stability of voltage regulator is determined. The general form of feedback signal $F_b(s)$ is given by:

$$F_b(s) = V_{out}\left(\frac{\frac{1}{Cs} + 2R}{\frac{1}{Cs} + R}\right) = V_{out}\left(\frac{1 + 2RCs}{1 + RCs}\right).$$

Solving for the pole and zero frequencies of feedback signal Fb(s) yields:

$$F_p = \frac{1}{2\pi RC}, \text{ and}$$

$$F_z = \frac{1}{4\pi RC}.$$

As illustrated above, the frequency of pole $F_p$ corresponds to twice the frequency of zero $F_z$ when $F_1(s)$ is selected as a capacitor (320), and $F_2(s)$ is selected as a resistor(310). Since the pole is always twice the frequency of the zero, good pole/zero separation is achieved.

As illustrated in FIG. 2, the present invention provides a flexible approach to compensating the voltage regulator for stable operation. The example of FIG. 3A is presented as but one of a multiplicity of embodiments and does not reflect all possible combinations for network elements as are within the scope of the invention. By contrast the capacitor (320) could be any single element or alternatively, a series or parallel combination of elements such as resistors, capacitors, or inductors, for example. Similarly, resistor (310) may be another element or combination of elements or may be omitted altogether. Frequently, active devices, such as transistors for example, are utilized as impedance loads having complex transfer functions. Utilization of such devices to practice the invention is within the scope of the invention.

Figure 3B:
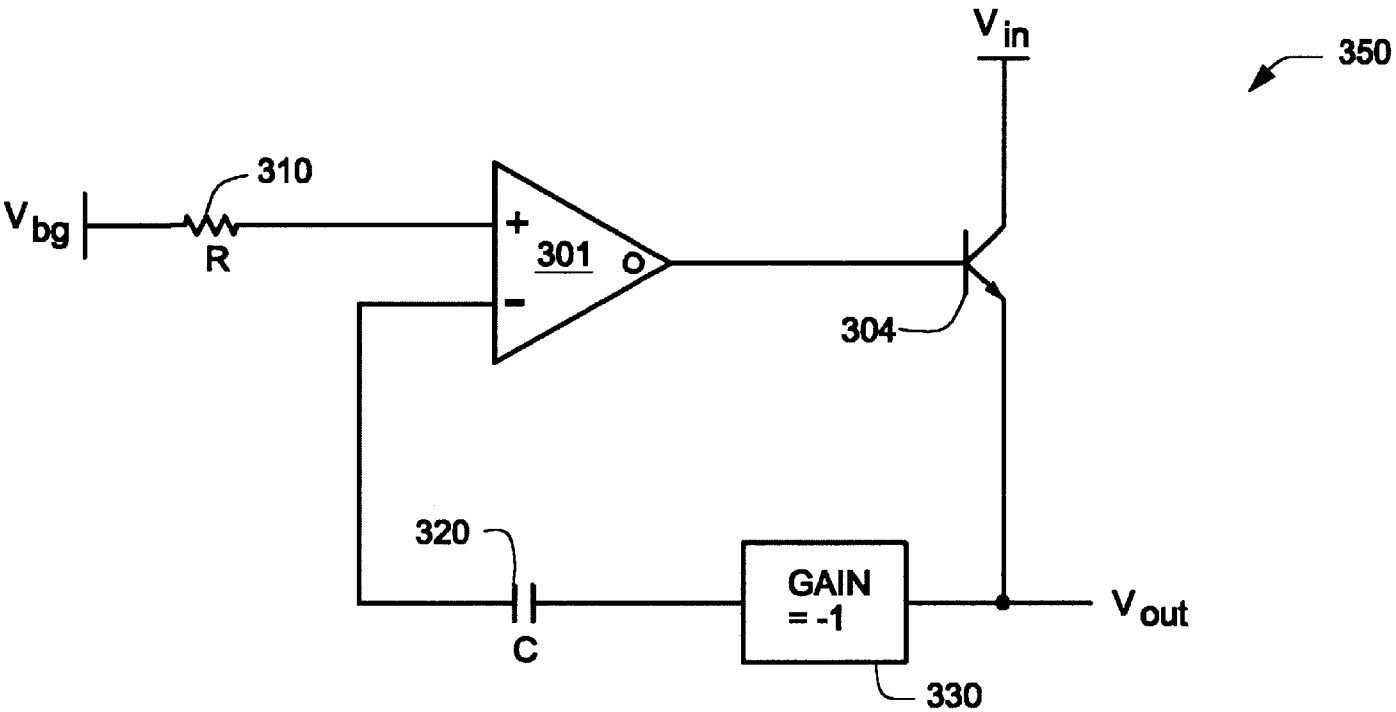
FIG. 3B is a second schematic diagram illustrating a variation of the LDO voltage regulator illustrated in FIG. 3A.

FIG. 3B is a schematic diagram illustrating an LDO voltage regulator (350) that is compensated for stable operation as in FIG. 3A. In FIG. 3B, the LDO voltage regulator (300) includes an amplifier circuit (301), a pass circuit (304), and a negative gain circuit (330). The operation of LDO voltage regulator 350 is substantially the same as that for LDO voltage regulator 300 illustrated in FIG. 3A. However, in FIG. 3B, the pass circuit is represented as an N-type transistor.

The N-type device may be a transistor that includes a collector (or drain) that receives power from the supply voltage ($V_{in}$), a base (or gate) that is coupled to the output of the amplifier (301), and an emitter (or source) that is coupled to the output node. Alternatively the N-type device may be a vacuum tube, where the grid is coupled to the output of the amplifier (301), the plate is coupled to the supply voltage (Vin), and the cathode is coupled to the output node. In these examples, there is no signal inversion between the output of the amplifier and the output voltage (Vout), and the inverting and non-inverting input terminals of the amplifier (301) are connected different than that illustrated in FIG. 3A. The output node is coupled to the inverting input (−) of the amplifier (301) through the negative gain circuit (330) and a capacitor (320), while the voltage reference (Vbg) is coupled to the non-inverting input (+) of the amplifier (301) through a resistor (310). The operation of amplifiers 301 depicted in FIGS. 3A and 3B are substantially the same.

Second Example Compensation Configuration

Figure 4A:
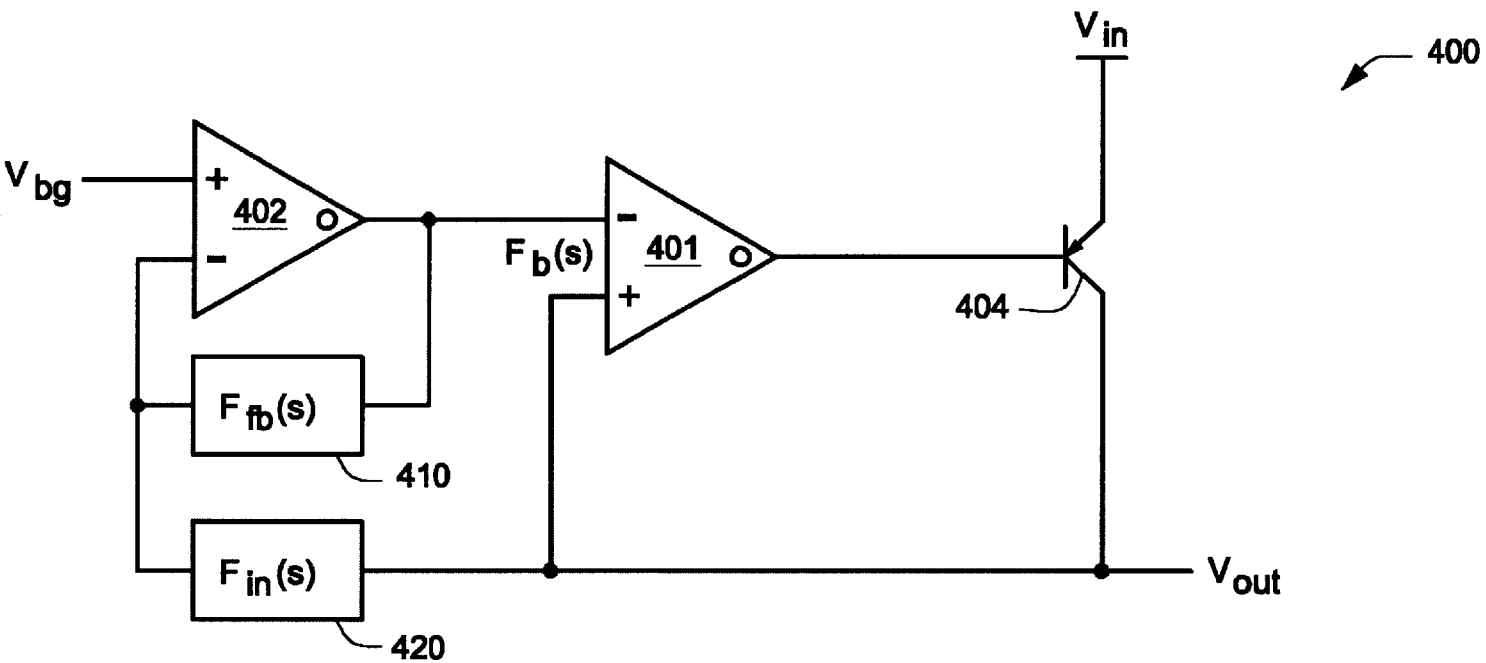
FIG. 4A is a schematic diagram illustrating another LDO voltage regulator compensation configuration.

FIG. 4A is a schematic diagram illustrating a second LDO voltage regulator (400) that is compensated for stable operation in accordance with the present invention. In FIG. 4A, the LDO voltage regulator (400) includes a first amplifier circuit (401), a second amplifier circuit (402) a pass circuit (404), a first network (420), and a second network (410).

The first and second amplifier circuits (401, 402) each include a non-inverting input (+), an inverting input (−), and an output (o). The reference voltage ($V_{bg}$) is coupled to non-inverting input (+) of the second amplifier circuit (402). The first network (420) is coupled between an output node and the inverting input (−) of the second amplifier circuit (402). The second network (410) is coupled between the inverting input (−) and the output (o) of the second amplifier circuit (402). The output of the second amplifier circuit (402) is coupled to the inverting input (−) of the first amplifier circuit (401). The non-inverting input (+) of the first amplifier circuit (401) is coupled to the output node. The pass circuit (404) is coupled between an unregulated supply voltage (Vin) and the output node. The pass circuit also includes a control terminal that is coupled to the output of the first amplifier circuit (401).

In operation, an input voltage source (not shown) that has a low source-impedance provides the unregulated supply voltage ($V_{in}$), and a reference circuit (not shown) is arranged to provide the reference voltage ($V_{bg}$). In one example, a band-gap reference circuit is arranged to provide the reference voltage ($V_{bg}$). In the example illustrated in FIG. 4A, the reference voltage ($V_{bg}$) is generally of a lower potential than the supply voltage ($V_{in}$). Other voltage reference circuits that provide an appropriate reference voltage may also be employed such as a regulated reference circuit or an unregulated reference circuit.

The output (o) of the first amplifier circuit (401) is arranged to provide a control signal to the control input of the pass circuit (404). The pass circuit (404) selectively couples power from the unregulated supply voltage ($V_{in}$) to the output node in response to the control signal such that a regulated output voltage ($V_{out}$) is provided at the output node. The pass circuit (404) illustrated in FIG. 4A is a PNP bipolar-junction transistor that has a base that is configured to receive the control signal, an emitter that is coupled to the unregulated input supply voltage (Vin), and a collector that is coupled to the output node. However, the pass circuit (404) may be any device (or devices) that is suitable to selectively provide power from the input supply voltage ($V_{in}$) to the output control supply power from the supply voltage ($V_{in}$) when a control signal is applied, such as, but not limited to, a MOSFET, a JFET, GaAs FET, or another controlled circuit.

The second amplifier circuit (402), and the first and second networks (410, 420) operate as compensation network that is arranged to stabilize the LDO voltage regulator (400). The compensation network operates as an inverting amplifier with respect to the output node such that negative feedback to occur at the positive feedback node (i.e., the inverting input terminal) of the first amplifier circuit (401).

A feedback signal, represented by $F_b(s)$, appears between the non-inverting input (+) and the inverting input (−) of the first amplifier circuit (401). Feedback signal $F_b(s)$ is determined by evaluating the potential difference between the non-inverting (+) and inverting (−) inputs of the first amplifier circuit (401). By analyzing the relationship between the feedback signal and the output signal in the AC domain, the stability of voltage regulator is determined. The general form of feedback signal $F_b(s)$ is given by:

$$F_b(s) = V_{out} - \left(\frac{-F_{fb}(s)}{F_{\text{in}}(s)}\right)V_{out} = V_{out}\left(\frac{F_{\text{in}}(s) + F_{fb}(s)}{F_{\text{in}}(s)}\right).$$

The LDO regulator configuration of FIG. 4A allows a very wide range of compensation to be utilized while maintaining excellent phase margin. By properly adjusting the first and second networks ($F_{in}(s)$ and $F_{fb}(s)$), the stability of LDO voltage regulator 400 can be adjusted. The first network (420) and the second network (410) may be complex impedance networks that include passive and/or active devices. For example, the first network (420) may include a resistor, a capacitor, an inductor, and/or any active or passive device in series and/or parallel arrangement. The first network (420) is represented by the frequency-dependent function, $F_{in}(s)$. The second network (410) is represented by the frequency-dependent function $F_{fb}(s)$.

Zero Compensation Configuration with No Pole

The configuration illustrated in FIG. 4A may be arranged to provide for a zero in the feedback signal with no associated pole. This is achieved by carefully choosing the frequency dependent functions $F_{in}(s)$ and $F_{fb}(s)$. For example, the feedback signal equation when $F_{in}(s)$ is a capacitor and $F_{fb}(s)$ is a resistor is:

$$F_b(s) = V_{out}\left(\frac{\frac{1}{Cs} + R}{\frac{1}{Cs}}\right) = V_{out}(1 + RCs).$$

A review of the above equation reveals that the feedback signal has a zero that is positioned in the compensation feedback loop with no associated pole. Without an associated pole, the LDO voltage regulator (400) may be operated under a wide variety of load conditions without the instability. One inherent advantage of the present invention is that the LDO regulator provides stable operation with a gain magnitude of one. LDO voltage regulator 400 may be utilized at lower voltages since it is unity gain stable.

Fractional Pole Compensation Configuration

Figure 4B:
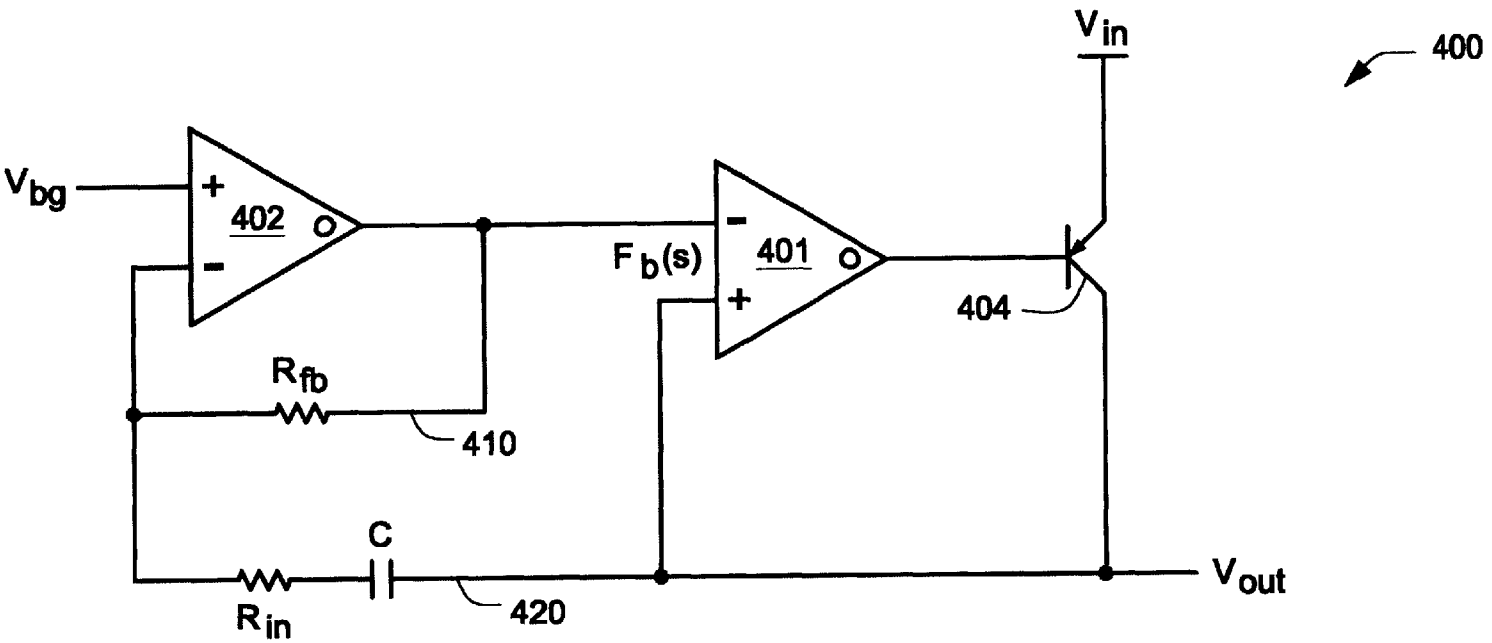

The configuration illustrated in FIG. 4A may be also arranged to provide for a zero in the feedback signal with a fractionally associated pole. This is again achieved by carefully choosing the frequency dependent functions $F_{in}(s)$ and $F_{fb}(s)$. For example as illustrated by FIG. 4B, the feedback signal equations when $F_{in}(s)$ is a resistor ($R_{in}$) coupled in series with a capacitor (C), and $F_{fb}(s)$ is a resistor ($R_{fb}$) is:

$$F_b(s) = V_{out}\left(\frac{\frac{1}{Cs} + R_{\text{in}} + R_{fb}}{\frac{1}{Cs} + R_{\text{in}}}\right) = V_{out}\left(\frac{1 + (R_{\text{in}} + R_{fb})Cs}{1 + R_{\text{in}}Cs}\right).$$

Solving for the pole and zero frequencies yields:

$$F_p = \frac{1}{2\pi R_{\text{in}}C}, \text{ and } F_z = \frac{1}{2\pi(R_{\text{in}} + R_{fb})C}.$$

A review the above equations reveals that the frequency of the zero may be any desired fraction of the pole frequency by appropriately choosing the network elements. In practice, the invention may be applied to tailor the pole-zero relationship for specific applications that require such LDO operational parameters as extra low voltage operation, or highly reactive loads for example.

Fractional-Zero Compensation Configuration

Figure 5:
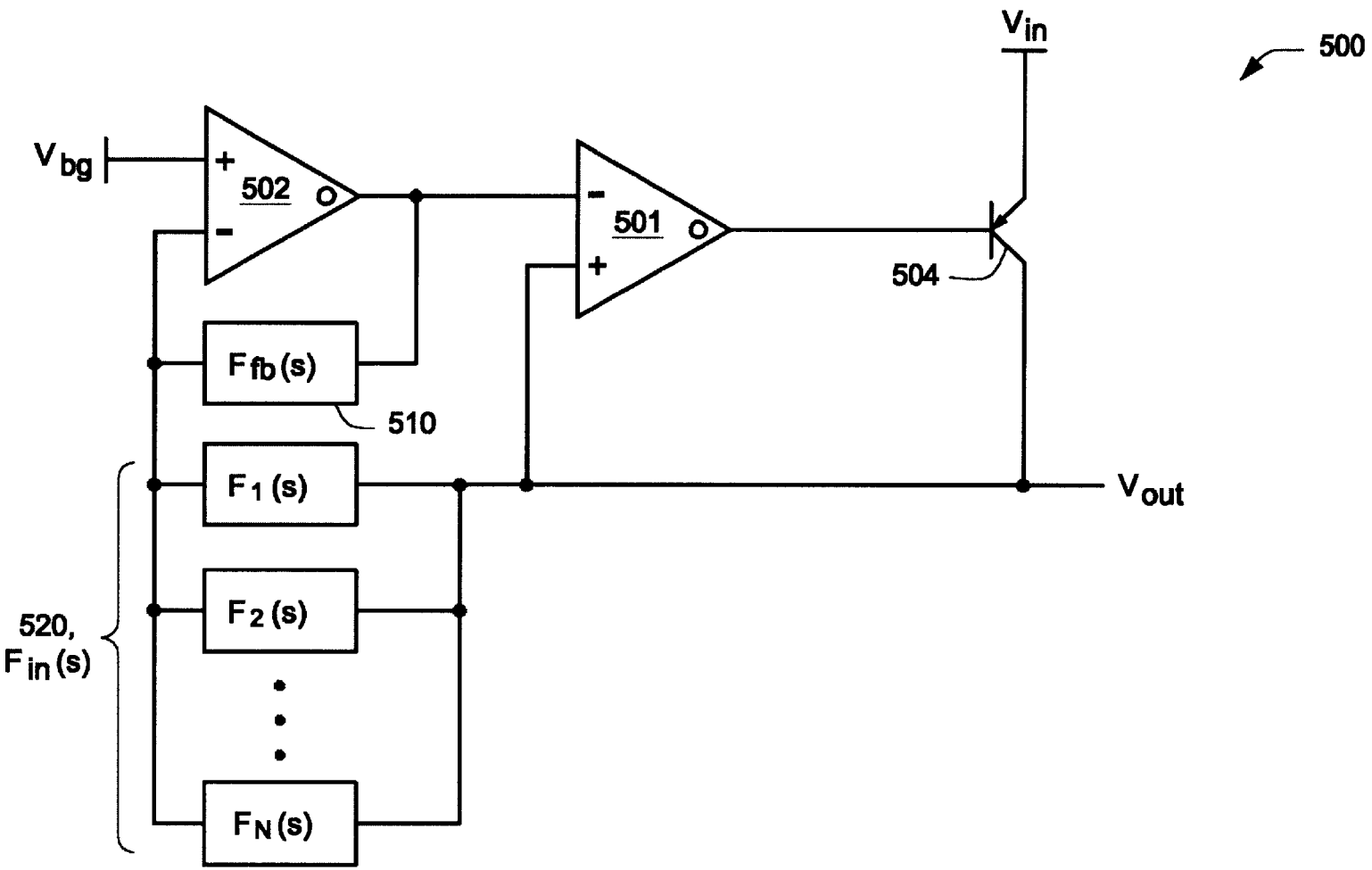
FIG. 5 is a schematic diagram illustrating yet another LDO voltage regulator compensation configuration, which is in accordance with the present invention.

FIG. 5 is a schematic diagram illustrating a third LDO voltage regulator (500) that is compensated for stable operation in accordance with the present invention. In FIG. 5, the LDO voltage regulator (500) includes a first amplifier circuit (501), a second amplifier circuit (502) a pass circuit (504), a first feedback circuit (520), and a second feedback circuit (510).

The first and second amplifier circuits (501, 502) each include a non-inverting input (+), an inverting input (−), and an output (o). The reference voltage ($V_{bg}$) is coupled to non-inverting input (+) of the second amplifier circuit (502). The first feedback circuit (520) is coupled between an output node and the inverting input (−) of the second amplifier circuit (502). The second feedback circuit (510) is coupled between the inverting input (−) and the output (o) of the second amplifier circuit (502). The output of the second amplifier circuit (502) is coupled to the inverting input (−) of the first amplifier circuit (501). The non-inverting input (+) of the first amplifier circuit (501) is coupled to the output node. The pass circuit (504) is coupled between an unregulated supply voltage ($V_{in}$) and the output node. The pass circuit also includes a control terminal that is coupled to the output of the first amplifier circuit (501).

The arrangement illustrated in FIG. 5 is substantially similar to the arrangement illustrated in FIG. 4A. However, the first network illustrated in FIG. 4A includes only a single network. In contrast, the first network illustrated in FIG. 5 includes a plurality of n-networks that are coupled in parallel with one another, where "in" corresponds to an integer that is at least two. Similar to FIG. 4A, a compensation circuit is formed by the combination of the first amplifier circuit (502), and the first and second feedback circuits (510, 520). The first feedback circuit (520) is represented by the frequency-dependent functions, $F_1(s)$, . . . , $F_n(s)$. The second feedback circuit (510) is represented by the frequency-dependent function $F_{fb}(s)$.

A feedback signal, represented by $F_b(s)$, appears between the non-inverting input (+) and the inverting input (−) of the first amplifier circuit (501). Feedback signal $F_b(S)$ is determined by evaluating the potential difference between the non-inverting (+) and inverting (−) inputs of the first amplifier circuit (501). By analyzing the relationship between the feedback signal and the output signal in the AC domain, the stability of voltage regulator is determined. The general form of feedback signal $F_b(s)$ is given by:

$$F_b(s) = V_{out}\left[1 - \left(\frac{-F_{fb}(s)}{F_1(s)}\right) - \left(1 - \frac{-F_{fb}(s)}{F_2(s)}\right) - \ldots \left(1 - \frac{-F_{fb}(s)}{F_n(s)}\right)\right],$$

which has the general complex equation form:

$$F_b(s) = V_{out}\left[\frac{(F_1(s)F_2(s)\ \ldots\ F_n(s)) + (F_2(s)F_3(s)\ \ldots\ F_n(s)F_{fb}(s)) + (F_1(s)F_3(s)\ \ldots F_n(s)F_{fb}(s)) + (F_1(s)\ \ldots\ F_{n-1}(s)F_{fb}(s))}{F_1(s)F_3(s)\ \ldots\ F_n(s)}\right].$$

The present invention illustrated in FIG. 5 may be observed by evaluating the simplest case where n=2. When n=2, two networks, $F_1(s)$ and $F_2(s)$, are coupled in parallel with one another, where each network includes a resistor $R_n$ that is coupled in series with a corresponding capacitor $C_n$. The feedback network is selected to be a resistor, $R_{fb}$. The general form of the transfer function of the differential feedback potential is then:

$$F_b(s) = V_{out}\left[\frac{\left(\frac{1}{C_{1S}} + R_1\right)\left(\frac{1}{C_{2S}} + R_2\right) + R_{fb}\left(\frac{1}{C_{2S}} + R_2\right) + R_{fb}\left(\frac{1}{C_{1S}} + R_1\right)}{\left(\frac{1}{C_{1S}} + R_1\right)\left(\frac{1}{C_{2S}} + R_2\right)}\right]$$

Which is approximately equivalent to:

$$F_b(s) \cong V_{out}\left[\frac{(1 + (R_2 + R_{fb})C_{2S})(1 + (R_1 + R_{fb})C_{1S})}{(1 + R_1C_{1S})(1 + R_2C_{2S})}\right].$$

Solving for the pole frequencies yields:

$$F_{p1} = \frac{1}{2\pi R_1 C_1}, \text{ and } F_{p2} = \frac{1}{2\pi R_2 C_2}.$$

Solving for the zero frequencies yields:

$$F_{z1} = \frac{1}{2\pi(R_1 + R_{fb})C_1}, \text{ and } F_{z1} = \frac{1}{2\pi(R_2 + R_{fb})C_2}.$$

Extrapolating these results to "n" networks provides a pole frequency of:

$$F_{pN} = \frac{1}{2\pi R_N C_N},$$

and a zero frequency of $$F_{zN} = \frac{1}{2\pi(R_N + R_{fb})C_N}.$$

Careful selection of network elements allows the staggering of poles and zeros on the complex plane such that compensation is achieved with a fractional or partial zero. The effect of the pole-zero location on stability is that the phase may be modulated over a frequency range of interest. For example, as a zero causes the phase to shift past 45 degrees, a strategically placed pole brings the phase back, but before the pole causes too much phase reversal, another zero causes phase to again shift out. The alternating pole-zero cycle is repeated based upon the number of network networks that are placed in parallel in the compensation loop.

Finally, an advantage of each of the embodiments of the invention as described above is the freedom to employ components such as load and bypass low-ESR capacitors. Such an advantage provides cost and design savings.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for regulating an output voltage at an output node in response to an input voltage that is supplied from a voltage source, comprising:

a compensation circuit that includes a first feedback circuit, a second feedback circuit, and a negative gain circuit, wherein the compensation circuit is configured to provide a feedback signal that is inverted with respect to the output voltage;

an amplifier circuit that is arranged to produce a control signal in response to the feedback signal and the output voltage; and a pass circuit that is arranged to selectively couple power from the voltage source to the output node in response to the control signal, wherein the apparatus has an associated closed-loop transfer function that is unity gain stable and has a zero that is determined by the compensation circuit.

2. The apparatus of claim 1, wherein the first feedback circuit has a first associated transfer characteristic ($F_{in}(s)$), the second feedback circuit has a second associated transfer characteristic ($F_{fb}(s)$), and the closed loop transfer function ($F_{fb}(s)$) is given by:

$$F_b(s) = V_{out}\left(\frac{F_{in}(s) + F_{fb}(s)}{F_{in}(s)}\right).$$

3. The apparatus of claim 2, wherein the first associated transfer characteristic ($F_{in}(s)$) is given by:

$$F_{in}(s) = \sum_{i=1}^{n} F_i(s)$$

wherein n corresponds to an integer that is greater than one, and the first associated transfer characteristic ($F_{in}(s)$) is arranged to provide for an effective half zero compensation in the apparatus by staggering poles and zeros in the complex plane.

4. The apparatus of claim 1, the second feedback circuit comprises capacitor.

5. The apparatus of claim 1, wherein the negative gain circuit is coupled between the output node and an intermediary node, the first feedback circuit is coupled between the intermediary node and a feedback node, and the second feedback circuit is coupled to between a reference node and the feedback node, wherein the feedback signal is provided at the feedback node, and a reference voltage is provided to the reference node.

6. The apparatus of claim 1, wherein the first feedback circuit has a first associated transfer characteristic ($F_1(s)$), the second feedback circuit has a second associated transfer characteristic ($F_2(s)$), and the closed loop transfer function ($F_b(s)$) is given by:

$$F_b(s) = V_{out}\left(\frac{F_1(s) + 2F_2(s)}{F_1(s) + F_2(s)}\right).$$

7. The apparatus of claim 1, wherein the first feedback circuit is a capacitive circuit that has an associated capacitance (C), the second feedback circuit is a resistive circuit that has an associated resistance (R), and the closed loop transfer function ($F_b(s)$) is given by:

$$F_b(s) = V_{out}\left(\frac{1 + 2RCs}{1 + RCs}\right).$$

8. The apparatus of claim 7, wherein the closed loop transfer function has an associated pole frequency ($F_p$) and a zero frequency ($F_z$) that are given by:

$$F_p = \frac{1}{2\pi RC}, \text{ and}$$

$$F_z = \frac{1}{4\pi RC}$$

such that the zero frequency corresponds to one-half of the pole frequency.

9. The apparatus of claim 1, wherein the first feedback circuit is coupled between the output node and an intermediary node, the second feedback circuit is coupled to between the intermediary node and a feedback node, and the negative gain circuit corresponds to another amplifier circuit that is coupled between the intermediary node and the feedback node such that the other amplifier circuit is configured as an inverting amplifier that provides the feedback signal at the feedback node.

10. The apparatus of claim 1, wherein the first feedback circuit is a capacitive circuit that has an associated capacitance (C), the second feedback circuit is a resistive circuit that has an associated resistance (R), and the closed loop transfer function ($F_b(S)$) is given by $F_b(s)=V_{out}(1+RCs)$, such that the closed loop transfer function includes a zero without an associated pole.

11. The apparatus of claim 1, wherein the first feedback circuit includes a resistance ($R_{in}$) that is coupled in series with a capacitance (C), the second feedback circuit includes another resistance ($R_{fb}$), and the associated transfer function is given by:

$$F_b(s) = V_{out}\left(\frac{1 + (R_{in} + R_{fb})Cs}{1 + R_{in}Cs}\right).$$

12. The apparatus of claim 11, wherein the transfer function has an associated pole frequency ($F_p$) and a zero frequency ($F_z$) that are given by:

$$F_p = \frac{1}{2\pi R_{in}C}, \text{ and}$$

$$F_z = \frac{1}{2\pi(R_{in} + R_{fb})C}$$

such that the zero frequency is a fraction of the pole frequency.

13. The apparatus of claim 1, the first feedback circuit comprises capacitor.

14. An apparatus for regulating an output voltage at an output node in response to an input voltage that is supplied from a voltage source, comprising:

a means for comparing that is arranged to compare an output signal from an output of the voltage regulator and a feedback signal to provide a control signal;

a means for coupling power that is arranged to couple power from the voltage source to the output node in response to the control signal; and a means providing feedback that is arranged to provide a feedback signal in response to the output signal, wherein the means for providing feedback includes inverting gain with respect to the output signal such that the a closed-loop transfer function associated with the voltage regulator includes a zero that corresponds to a feed-forward zero that is associated with the inverting gain in the feedback circuit.

15. A method for improving stability in a voltage regulator, comprising:

comparing an output signal from an output of the voltage regulator and a feedback signal to provide a control signal;

activating a pass circuit in response the control signal such that power is coupled from a power supply to the output node when the pass circuit is active;

coupling the output node to a feedback circuit;

arranging the feedback circuit to provide inverting gain with respect to the output signal; and compensating the stability of the voltage regulator with the feedback circuit such that a zero is provided in a closed loop transfer function that is associated with the voltage regulator, wherein the zero is a feed-forward zero that is associated with the inverting gain in the feedback circuit.

16. The method of claim 2, wherein the feedback circuit is arranged to provide a zero without an associated pole.

17. The method of claim 2, wherein the feedback circuit is arranged to provide a zero with a frequency that corresponds to one-half of an associated pole frequency.

18. The method of claim 2, wherein the feedback circuit is arranged to provide a zero with a frequency that corresponds to a fraction of an associated pole frequency.

19. The method of claim 2, wherein the feedback circuit is arranged to provide a multiplicity of staggered poles and zeros that are configured to provide fractional-zero compensation.

* * * * *

UNITED STATES PATENT AND TRADEMARK OFFICE

CERTIFICATE OF CORRECTION

PATENT NO. : 6,522,112 B1 
DATED : February 18, 2003
INVENTOR(S) : James Charles Schmoock and Jeffrey P. Kotowski It is certified that error appears in the above-identified patent and that said Letters Patent is hereby corrected as shown below:

Column 11,
Claim 4 should read -- The apparatus of claim 1, wherein the second feedback circuit comprises a capacitor. --

Column 12,
Claim 13 should read -- The apparatus of claim 1, wherein the first feedback circuit comprises a capacitor. --
Line 41, remove the word “the” voltage regulator and add the word -- a -- voltage regulator
Line 51, remove the word “the”
Line 52, remove the word “the” voltage regulator and add the word -- a -- voltage regulator
Line 54, remove the word “circuit”

Signed and Sealed this

Sixteenth Day of September, 2003

JAMES E. ROGAN
*Director of the United States Patent and Trademark Office*